US006450148B2

(12) United States Patent
Nakamura et al.

(10) Patent No.: US 6,450,148 B2
(45) Date of Patent: Sep. 17, 2002

(54) FUEL PRESSURE CONTROL DEVICE OF ENGINE

(75) Inventors: Yoshitatsu Nakamura; Masaki Nakamura; Toru Kitayama, all of Atsugi (JP)

(73) Assignee: Unisia Jecs Corporation, Kanagawa-Ken (JP)

( * ) Notice: Subject to any disclaimer, the term of this patent is extended or adjusted under 35 U.S.C. 154(b) by 6 days.

(21) Appl. No.: 09/725,866

(22) Filed: Nov. 30, 2000

(30) Foreign Application Priority Data

Nov. 30, 1999 (JP) ..... 11-340071

(51) Int. Cl.[7] ..... F02M 41/00
(52) U.S. Cl. ..... 123/464; 123/497
(58) Field of Search ..... 123/464, 458, 123/497, 457, 511, 512, 513, 456, 447

(56) References Cited

U.S. PATENT DOCUMENTS

| | | | | |
|---|---|---|---|---|
| 5,542,395 A | * | 8/1996 | Tuckey et al. | 123/497 |
| 5,605,133 A | * | 2/1997 | Tuckey | 123/458 |
| 6,067,963 A | * | 5/2000 | Oi et al. | 123/458 |
| 6,230,684 B1 | * | 5/2001 | Furuhashi et al. | 123/467 |

FOREIGN PATENT DOCUMENTS

| | | |
|---|---|---|
| JP | 07-293397 | 11/1995 |
| JP | 09-222037 | 8/1997 |

* cited by examiner

*Primary Examiner*—Willis R. Wolfe
*Assistant Examiner*—Mahmoud Gimie
(74) *Attorney, Agent, or Firm*—Sughrue Mion, PLLC

(57) ABSTRACT

In a device for controlling the pressure of fuel supplied from a fuel pump to a fuel injection valve, a target fuel pressure corresponding to the engine operation condition is controlled to a lower limit value set based on an engine environmental temperature.

14 Claims, 9 Drawing Sheets

FUEL PRESSURE CONTROL DEVICE OF ENGINE

BACKGROUND OF THE INVENTION

1. Field of the Invention

The present invention relates to technology for controlling the fuel pressure supplied to fuel injection valves of an engine.

2. Related Art of the Invention

As a fuel supply device to an engine, there has been proposed a system of a constitution in which, in order to prevent a rise in the fuel temperature due to excess fuel returned from a pressure regulator to a fuel tank, the pressure regulator is abolished but, instead, a sensor is provided to detect the fuel pressure in a fuel supply passage, and the discharge amount of the fuel pump is controlled according to the fuel pressure detected by the sensor in order to obtain the fuel pressure required by the operation conditions, so that the discharge amount of the fuel pump is made to correspond to a required fuel amount, to suppress the generation of excess fuel (see Japanese Unexamined Patent Publication No. 7-293397).

In the fuel supply device of this type, the fuel pressure is required to be as low as possible in order to reduce the electric power consumption of the fuel pump. In order to prevent the fuel from vaporizing in the fuel supply passage under a heat-resisting environmental condition (high temperature condition), however, a margin has been imparted to the lower limit value of a target fuel pressure; i.e., the lower limit value of the target fuel pressure has been set to be slightly high. Accordingly, the fuel pressure is not lowered to a sufficient degree, and the consumption of electric power is not saved to a sufficient degree.

There has also been proposed a technology for setting the lower limit value of the fuel pressure so that the fuel is injected in a required amount within a limited fuel injection period at the start of engine. This, however, is not to lower the fuel pressure (see Japanese Unexamined Patent Publication No. 9-222037).

SUMMARY OF THE INVENTION

The present invention was accomplished in view of the above-mentioned conventional problem, and its object is to accomplish a sufficient effect by reduction of electrical power consumption by controlling the fuel pressure to a minimum required level.

It is a further object of the present invention to accomplish the above-mentioned effect with a simple constitution.

It is a further object of the present invention to maintain the above-mentioned effect to a sufficient degree by controlling the fuel pressure with a high accurately.

In order to accomplish the above-mentioned objects, according to the present invention, the constitution is such that an operation of a fuel pump is controlled so that the pressure of fuel supplied from the fuel pump to a fuel injection valve becomes a target fuel pressure corresponding to an engine operation condition, and a lower limit value of the target fuel pressure is set according to an engine environmental temperature.

In this way, during the engine operation, the fuel pressure is controlled to become the target fuel pressure set corresponding to the engine operation condition. Here, the engine environmental temperature participating with the fuel vapor generation is detected, and the lower limit value of the target fuel pressure is variably set according to the engine environmental temperature.

With this constitution, under the condition of low engine environmental temperature, the lower limit value is set to be low, so that the target fuel pressure is prevented from being limited to a higher value by the lower limit value and, hence, reducing the electric power consumption of the fuel pump to a sufficient degree and enhancing the fuel economy.

The constitution may be such that an engine cooling water temperature is detected and, hence, an engine environmental temperature condition is detected based on the detected value.

With this constitution, the engine environmental temperature condition participating with the fuel vapor generation is easily detected without the rise of cost, since a value detected by a water temperature sensor indispensable the engine control is used.

Further, the constitution may be such that an outer air temperature is detected in addition to the engine cooling water temperature and, hence, the engine environmental temperature condition is detected based on these detected values.

With this constitution, by using the outer air temperature as well as the engine cooling water temperature, it is possible to more accurately detect the engine environmental temperature condition participating with the fuel vapor generation.

Further, the constitution may be such that an on or off state of an air conditioner is detected in addition to the engine cooling water temperature and, hence, the engine environmental temperature condition is detected based on these detected values.

With this constitution, by adding the on or off information of the air conditioner switch as well as the engine cooling water temperature, it is possible to more accurately detect the engine environmental temperature condition participating with the fuel vapor generation.

Moreover, the constitution may be such that the fuel temperature is detected and, hence, the engine environmental temperature is detected based on the detected value.

With this constitution, by using the fuel temperature directly detected, it is possible to most accurately detect the engine environmental temperature condition participating with the fuel vapor generation.

Furthermore, the constitution may be such that the fuel pressure is detected to feedback control the fuel pressure to the target fuel pressure based on the detected value.

That is, a high accurate control becomes possible by adapting the present invention to a feedback control system, although the present invention can also be adapted to a feedforward control system.

The other objects and features of this invention will become understood from the following description with reference to the accompanying drawings.

DESCRIPTION OF THE PREFERRED EMBODIMENTS

Embodiments of the present invention will be explained hereinbelow with reference to the accompanied drawings.

Figure 1:
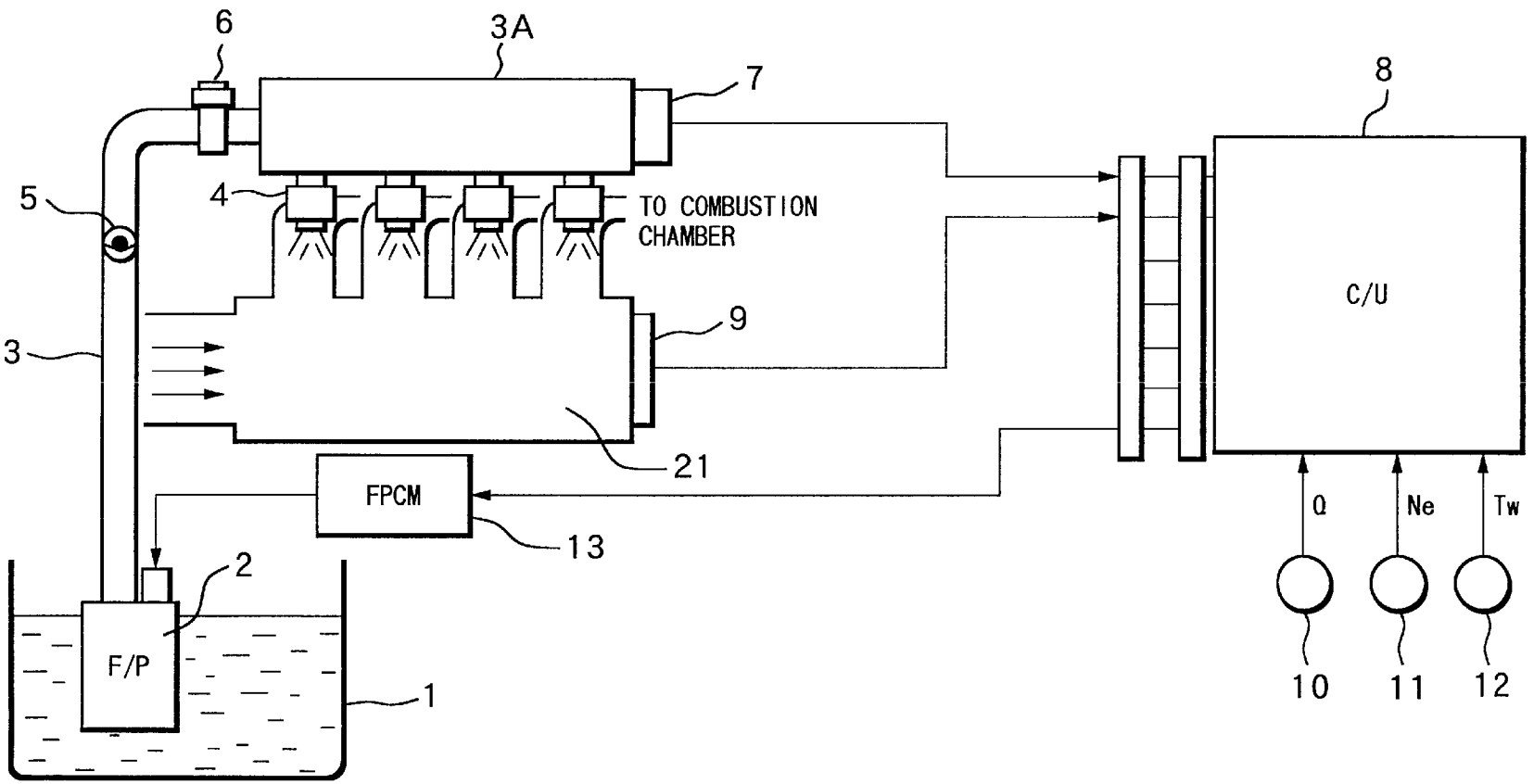
FIG. 1 is a diagram illustrating a system constitution of a first embodiment according to the present invention.

Referring to FIG. 1 illustrating a system constitution according to an embodiment, the fuel in a fuel tank 1 is sucked by an electrically operated fuel pump 2. The fuel discharged from the fuel pump 2 is sent with pressure to a fuel injection valve 4 in each cylinder through a fuel supply passage 3.

In the fuel supply passage 3, a check valve 5 and a fuel damper 6 are disposed from the upstream side. A fuel gallery unit 3A at the downstream end is provided with a fuel pressure sensor 7 for detecting the fuel pressure as a gauge pressure with respect to the atmospheric pressure.

The fuel injection valve 4 is of an electromagnetic type which opens when a current is supplied to the solenoid and closes when no current is supplied, and is controlled to open in response to a drive pulse signal of a predetermined pulse width Ti (valve-opening time) that corresponds to a required fuel amount of an engine, to be sent from a control unit 8 that will be described later. The fuel injection valve 4 injects fuel into an intake manifold 21 downstream of the throttle valve of the engine that is not shown.

The intake manifold 21 is provided with an intake air pressure sensor (absolute pressure sensor) 9 for detecting the negative intake pressure in the intake manifold 21 during the engine is in operation and detecting the atmospheric pressure during the engine operation is stopped.

The control unit 8 receives, in addition to a detection signal from the fuel pressure sensor 7, a detection signal of an intake air amount Q from an air flow meter 10, a signal of an engine rotational speed Ne from a crank angle sensor 11, and an engine cooling water temperature (hereinafter referred to as water temperature) Tw from a water temperature sensor 12.

The control unit 8 incorporating a microcomputer therein calculates the required fuel amount of the engine, i.e., a basic fuel injection pulse width Tp (basic valve-opening time) corresponding to a cylinder intake air amount based on the intake air flow rate Q and the engine rotational speed Ne, while setting a target fuel pressure of the fuel pump 2 based on the engine rotational speed Ne and the basic fuel injection pulse width Tp. Then, a basic duty set based on the engine rotational speed Ne and the basic fuel injection pulse width Tp, is feedback corrected by the PID control, based on the target fuel pressure and the fuel pressure detected by the fuel pressure sensor 7, to thereby obtain a control duty signal, and the control duty signal is output to a pump drive circuit (FPCM) 13 to control the fuel pump 2 so that the feedback control is performed to obtain a target fuel pressure.

On the other hand, the pulse width Ti obtained by correcting the basic fuel injection pulse width Tp by various correction coefficients COEF, etc. from the information of the cooling water temperature Tw, etc., is corrected according to the fuel pressure to set a final pulse width Ti'. More specifically, the fuel pressure sensor 7 detects the atmospheric pressure as a reference, and the intake air pressure sensor 9 detects the intake air pressure as an absolute pressure. Therefore, a value obtained by subtracting the intake air pressure from the atmospheric air pressure detected by the intake air pressure sensor 9 when the engine operation is stopped, is added to the detected fuel pressure to thereby calculate the fuel pressure with the intake air pressure as a reference, and the fuel injection pulse width is corrected based on the fuel pressure with the intake air pressure as a reference.

In the fuel pressure control apparatus in which the fuel pressure during the engine is in operation is controlled in the above manner, a target fuel pressure is set as described below. Though the fuel pressure can be highly accurately controlled by the feedback control while being detected, the present invention can be adapted to such a system for feedforward controlling the fuel pressure.

Figure 2:
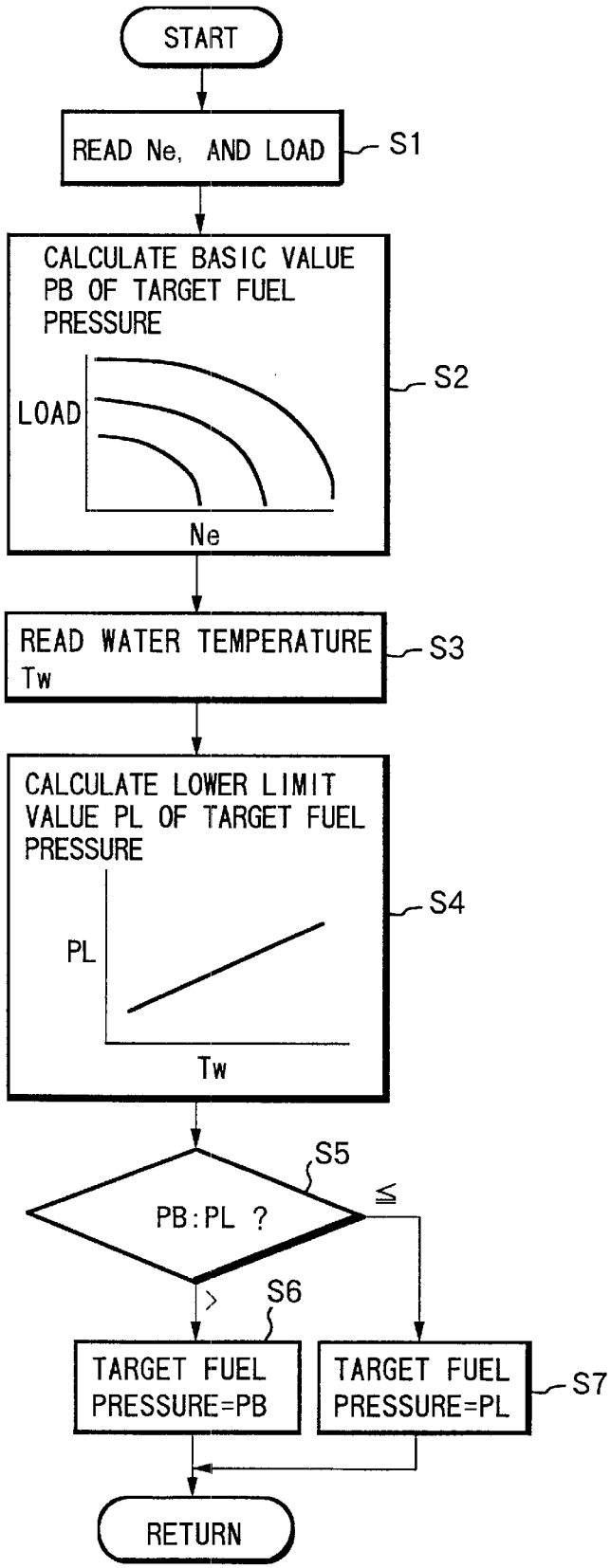
FIG. 2 is a flowchart of a fuel pressure control routine according to the first embodiment.

Next, the fuel pressure control (setting a target fuel pressure inclusive of setting a lower limit value) according to the present embodiment will be described with reference to a flowchart of FIG. 2.

At step 1, the engine rotational speed Ne and the load (e.g., the basic fuel injection amount Tp) are read.

At step 2, a basic value PB of a target fuel pressure corresponding to the operation condition is calculated from a map set in advance based on the engine rotational speed Ne and the load.

At step 3, a water temperature Tw detected by the water temperature sensor 12 is read as the engine environmental temperature.

At step 4, a lower limit value PL of the target fuel pressure is retrieved from a map set in advance based on the water temperature Tw. Here, the lower limit value PL is set to a small value when the water temperature Tw is low, and is set to a large value when the water temperature Tw is high. That is, when the water temperature is low, the fuel is unlikely to be vaporized since the fuel temperature is also low. Therefore, the lower limit value PL of the target fuel pressure can be lowered. When the water temperature becomes high, and the fuel becomes likely to be vaporized since also the fuel temperature becomes high. Therefore, the lower limit value PL is increased to prevent the fuel vapor generation.

At step 5, the basic value PB of the target fuel pressure is compared with the lower limit value PL thereof. When the basic value PB>lower limit value PL, the routine proceeds to step 6 to select the basic value PB. When the basic value PB≦lower limit value PL, the routine proceeds to step 7 to select the lower limit value PL. According to this processing, the target fuel pressure to be finally set is controlled not to become less than the lower limit value PL.

Figure 3:
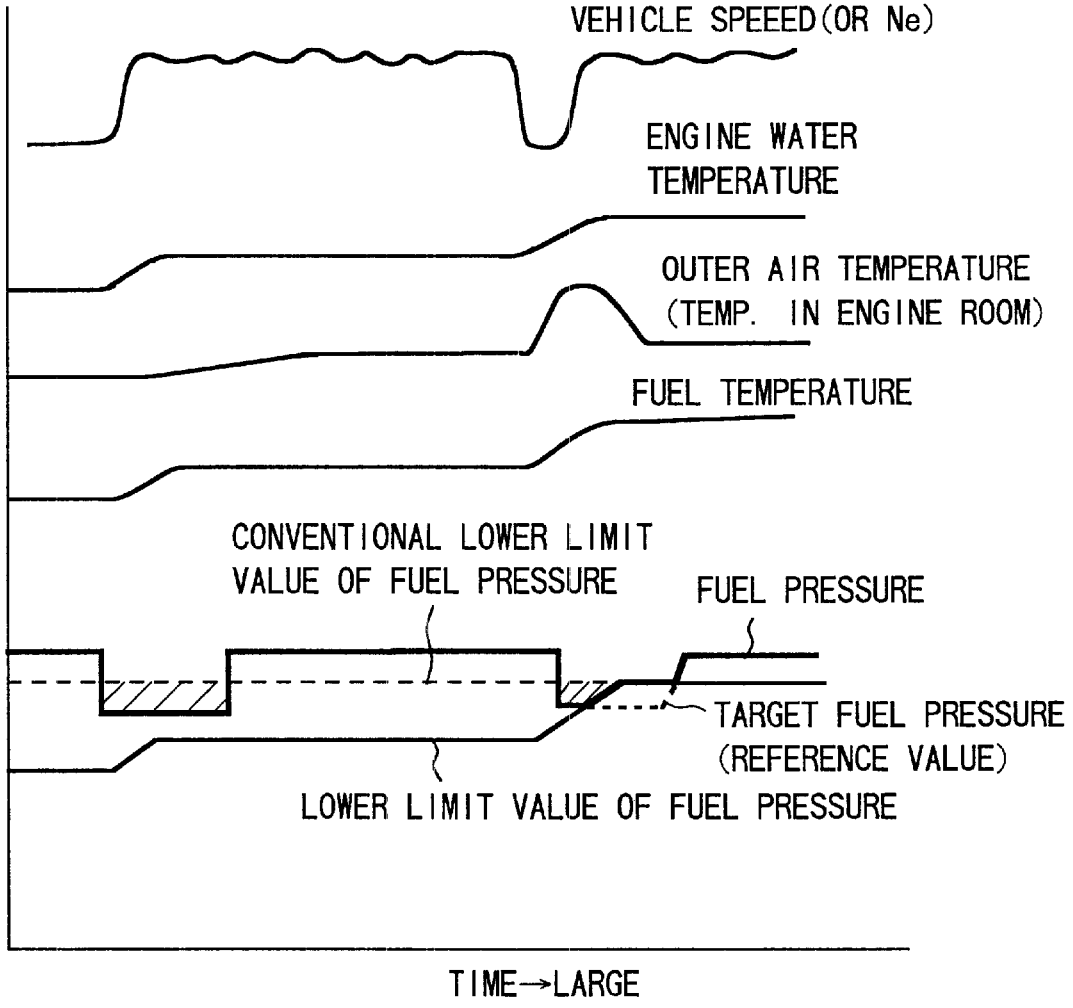
FIG. 3 is a time chart illustrating a change in the fuel pressure due to a change in the engine environmental temperature in the first embodiment.

FIG. 3 illustrates a change in the fuel pressure during the traveling in a case that the lower limit value is set as in this embodiment. The fuel pressure can be lowered as represented by hatched portions compared with the conventional lower limit value that is fixed as represented by a dotted line in the drawing.

As described above, the lower limit value PL of the target fuel pressure is lowered closely to a limit of fuel vapor generation based on the water temperature Tw. Thus, the fuel pressure can be lowered to a sufficient degree while preventing the fuel vapor generation, to thereby reduce the consumption of electric power and, hence, improve fuel economy.

Figure 4:
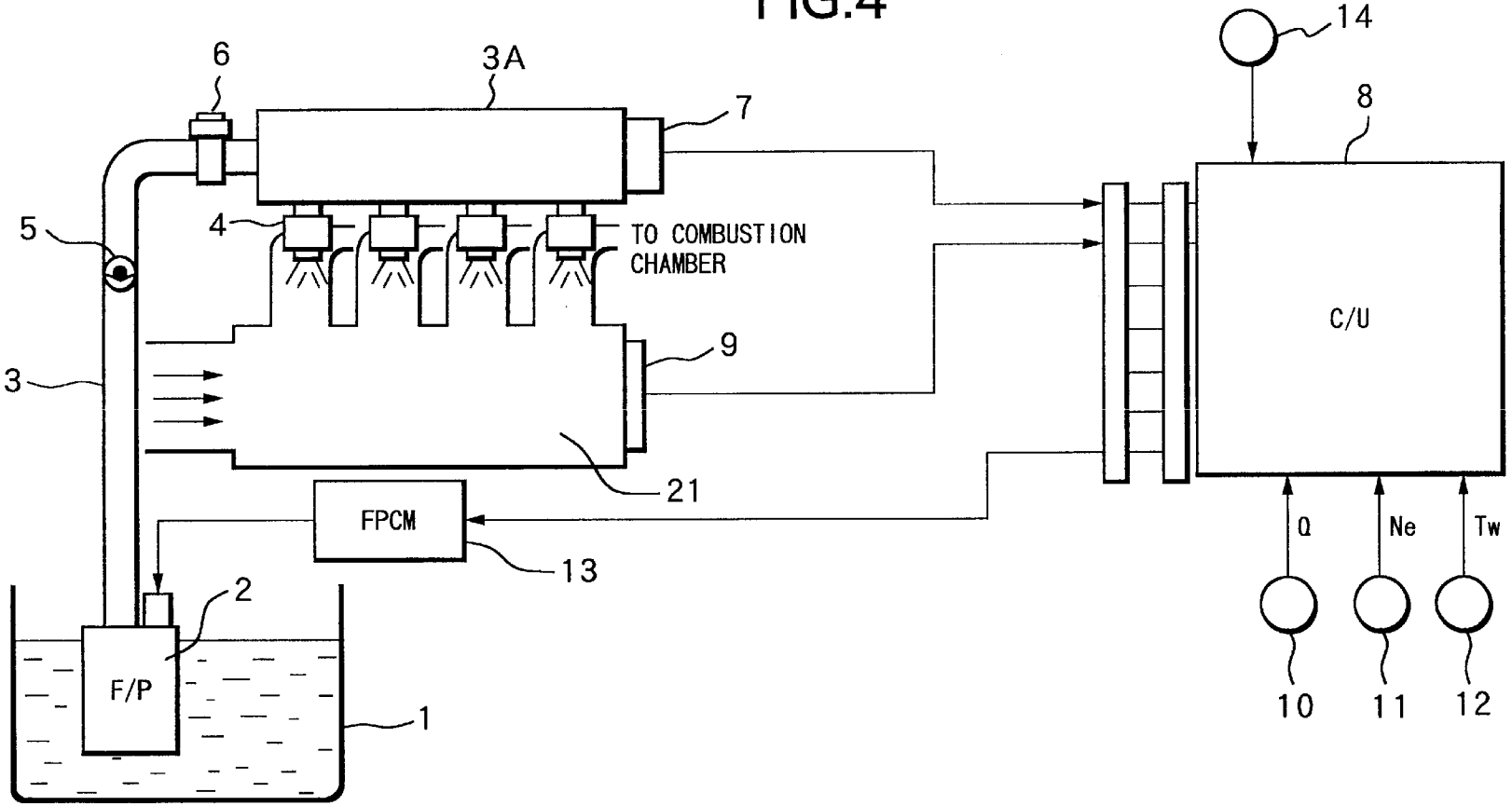
FIG. 4 is a diagram illustrating a system constitution of a second embodiment according to the present invention.

Next, a second embodiment will be described. As shown in FIG. 4, the system constitution is such that, in addition to the constitution of the first embodiment shown in FIG. 1, an outer air temperature sensor 14 for detecting the outer air temperature (temperature inside the engine room) Ta is provided to input a signal of the outer air temperature Ta to the control unit 8. The lower limit value of the target fuel pressure is set by taking the outer air temperature Ta in addition to the water temperature Tw into consideration.

Figure 5:
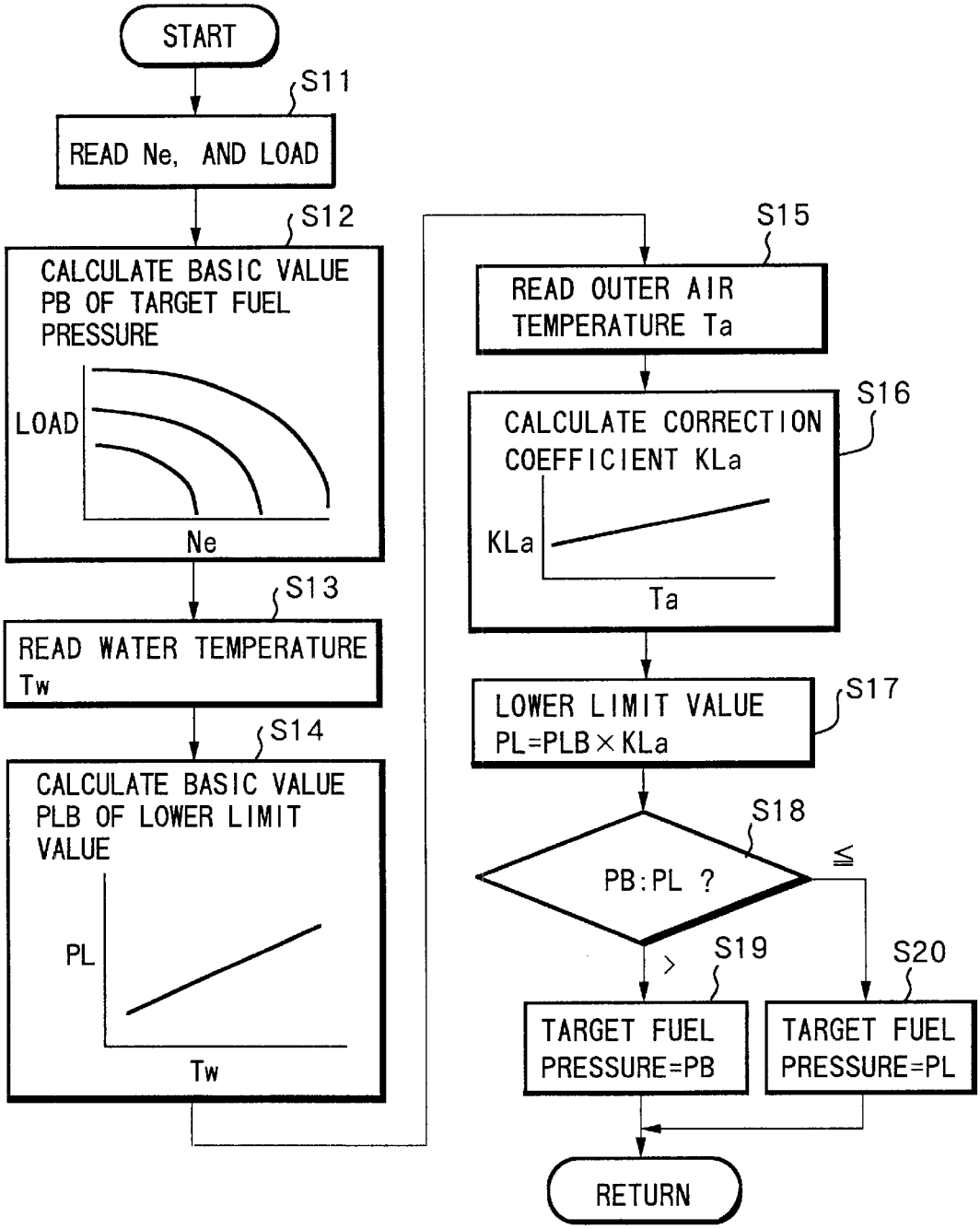
FIG. 5 is a flowchart of a fuel pressure control routine according to the second embodiment.

The fuel pressure control according to the second embodiment will be described with reference to a flowchart of FIG. 5.

At steps 11 and 12, a basic value PB of a target fuel pressure is calculated in the same manner as in the first embodiment, and at step 14, a basic value PLB of the lower limit value is calculated based on the water temperature Tw read at step S13. The basic value PLB is calculated by retrieval from a map set in advance, like the lower limit value PL in the first embodiment.

At step 15, the outer air temperature Ta detected by the outer air temperature sensor 14 is read and at step 16, a correction coefficient KLa is calculated by retrieval from the map based on the outer air temperature Ta. The correction coefficient KLa is set to a value that increases with an increase in the outer air temperature Ta.

At step 17, the basic value PLB of the lower limit value is multiplied by the correction coefficient KLa to calculate a final lower limit value PL of the target fuel pressure.

At steps 18 to 20, the basic value PB is compared with the lower limit value PL in the same manner as in the first embodiment. When the basic value PB>lower limit value PL, the basic value PB is selected. When the basic value PB≦lower limit value PL, the lower limit value PL is selected. According to this processing, the target fuel pressure to be finally set is controlled not to become less than the lower limit value PL.

Then, even under the same water temperature Tw, the lower limit value PL of the target fuel pressure is set to a small value when the outer air temperature Ta is low and is set to a large value when the outer air temperature Ta is high. Therefore, the lower limit value PL can be set according to a temperature closer to the fuel temperature to thereby perform a highly accurate control operation and effectively achieve the prevention of fuel vapor generation and the reduction of fuel economy.

Figure 6:
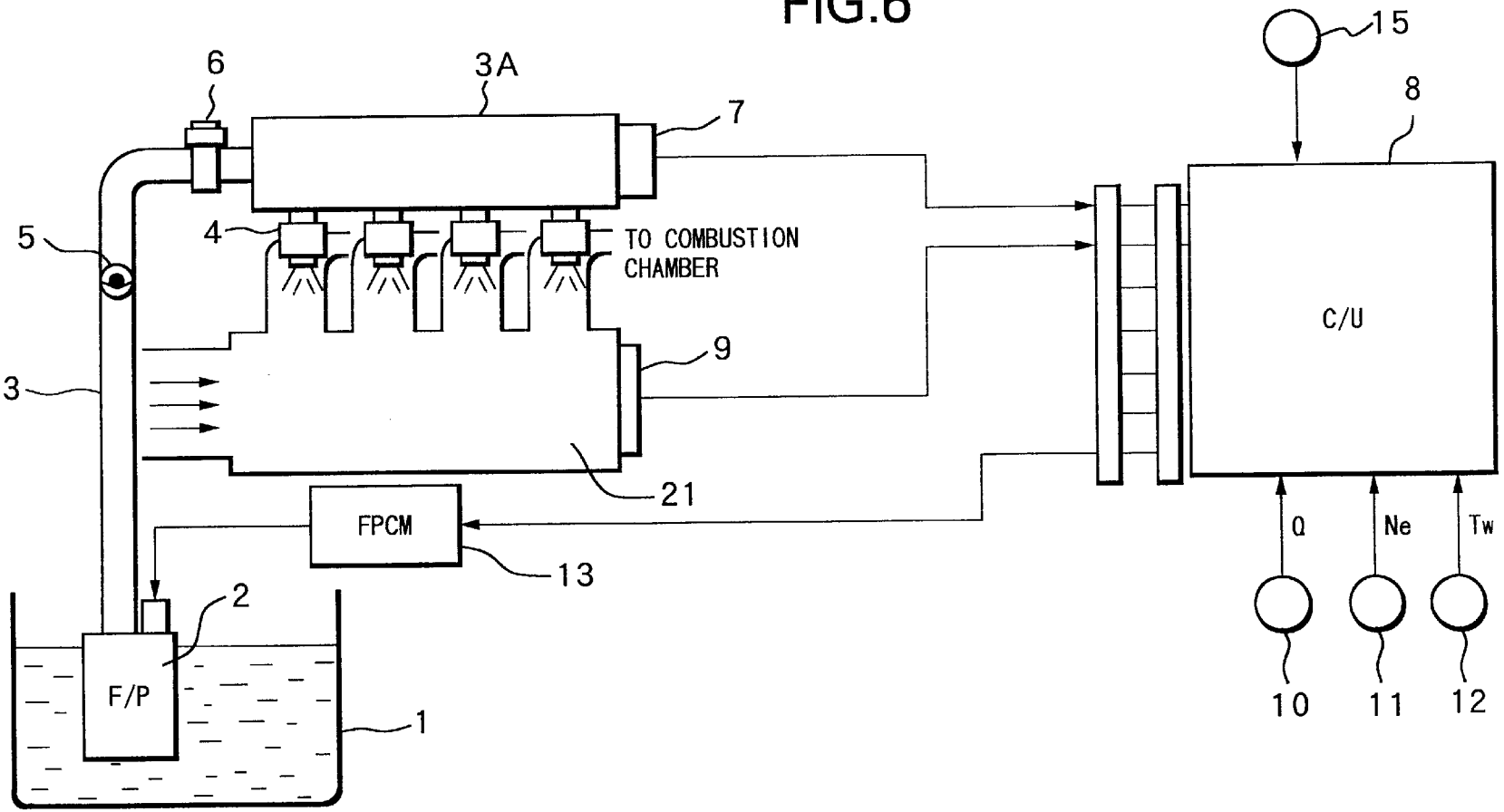
FIG. 6 is a diagram illustrating a system constitution of a third embodiment according to the present invention.

Next, described below is a third embodiment. As shown in FIG. 6, the system constitution is such that, in addition to the constitution of the first embodiment shown in FIG. 1, an ON/OFF signal of an air conditioner switch 15 is input to the control unit 8. The lower limit value of the target fuel pressure is set by taking the ON/OFF signal of the air conditioner switch 15 in addition to the water temperature Tw into consideration.

Figure 7:
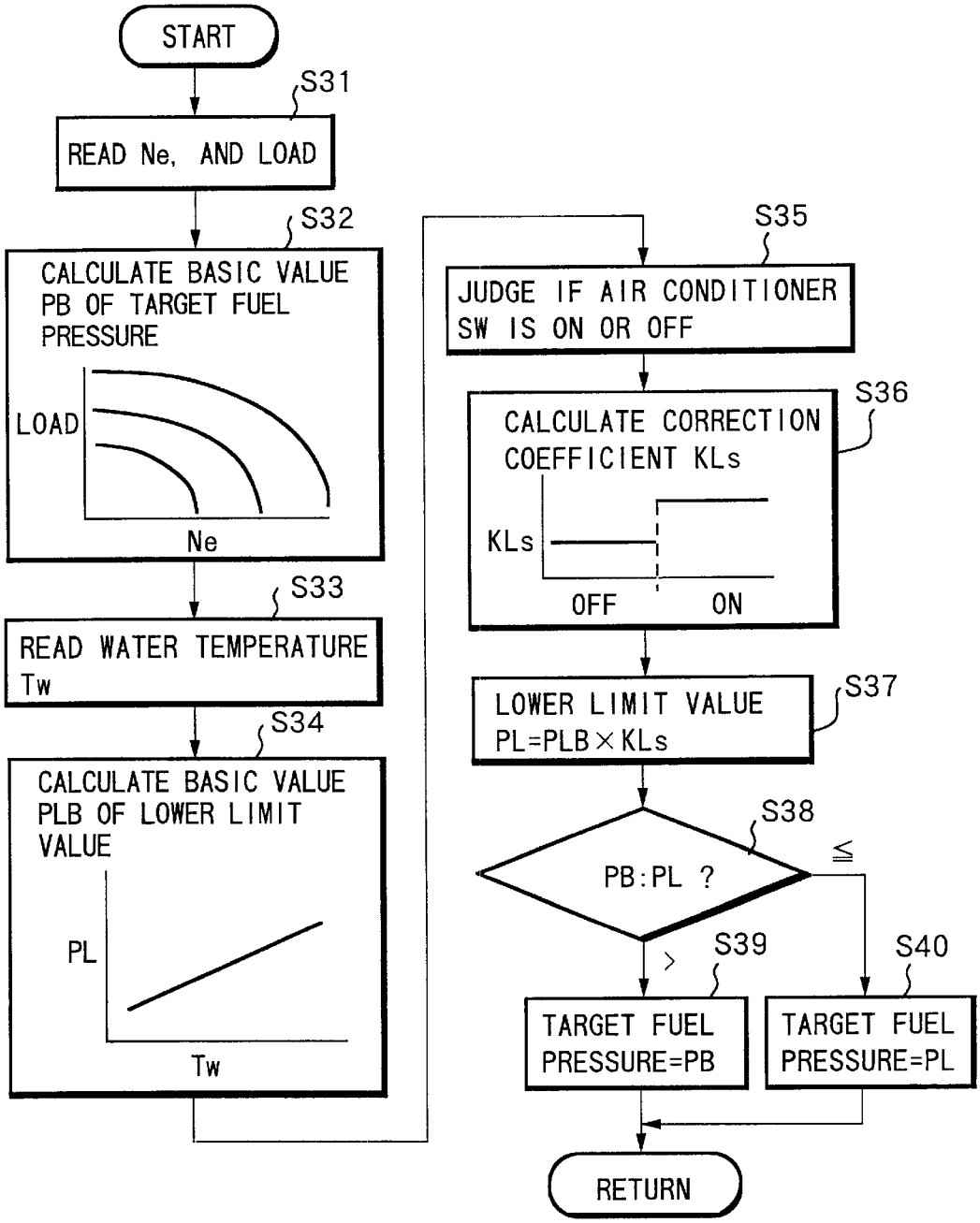
FIG. 7 is a flowchart of a fuel pressure control routine according to the third embodiment.

The fuel pressure control according to the third embodiment will be described with reference to a flowchart shown in FIG. 7.

At steps 31 to 34, a basic value PB of a target fuel pressure and a basic value PLB of the lower limit value based on the water temperature Tw are calculated in the same manner as in the second embodiment.

At step 35, the ON or OFF of the air conditioner switch 15 is judged and at step 36, a correction coefficient KLs is calculated by retrieval from the map based on the ON or OFF state. The correction coefficient KLs is set to a small value when the air conditioner switch 15 is in the OFF state and is set to a large value when the air conditioner switch 15 is in the ON state.

At step 37, the basic value PLB of the lower limit value is multiplied by the correction coefficient KLs to calculate a final lower limit value PL of the target fuel pressure.

At steps 38 to 40, the basic value PB is compared with the lower limit value PL in the same manner as in the first and second embodiments. When the basic value PB>lower limit value PL, the basic value PB is selected. When the basic value PB≦lower limit value PL, the lower limit value PL is selected. According to this processing, the fuel pressure to be finally set is controlled not to become less than the lower limit value PL.

Thus, even under the same water temperature Tw, it is judged that the outer air temperature is not so high when the air conditioner is in the OFF state, to set the lower limit value PL of the target fuel pressure to a small value, and it is judged that the outer air temperature is high when the air conditioner is in the ON state, to set the lower limit value PL of the target fuel pressure to a large value. Therefore, compared to the first embodiment, the lower limit value PL can be set according to a temperature closer to the fuel temperature, to thereby perform a highly accurate control operation and effectively achieve the prevention of fuel vapor generation and the reduction of fuel economy. Although the second embodiment is superior to the third embodiment from the standpoint of accuracy, the third embodiment can be put into practice at a low cost since the air conditioner switch can be utilized and there is no need to provide any particular outer air temperature sensor.

Figure 8:
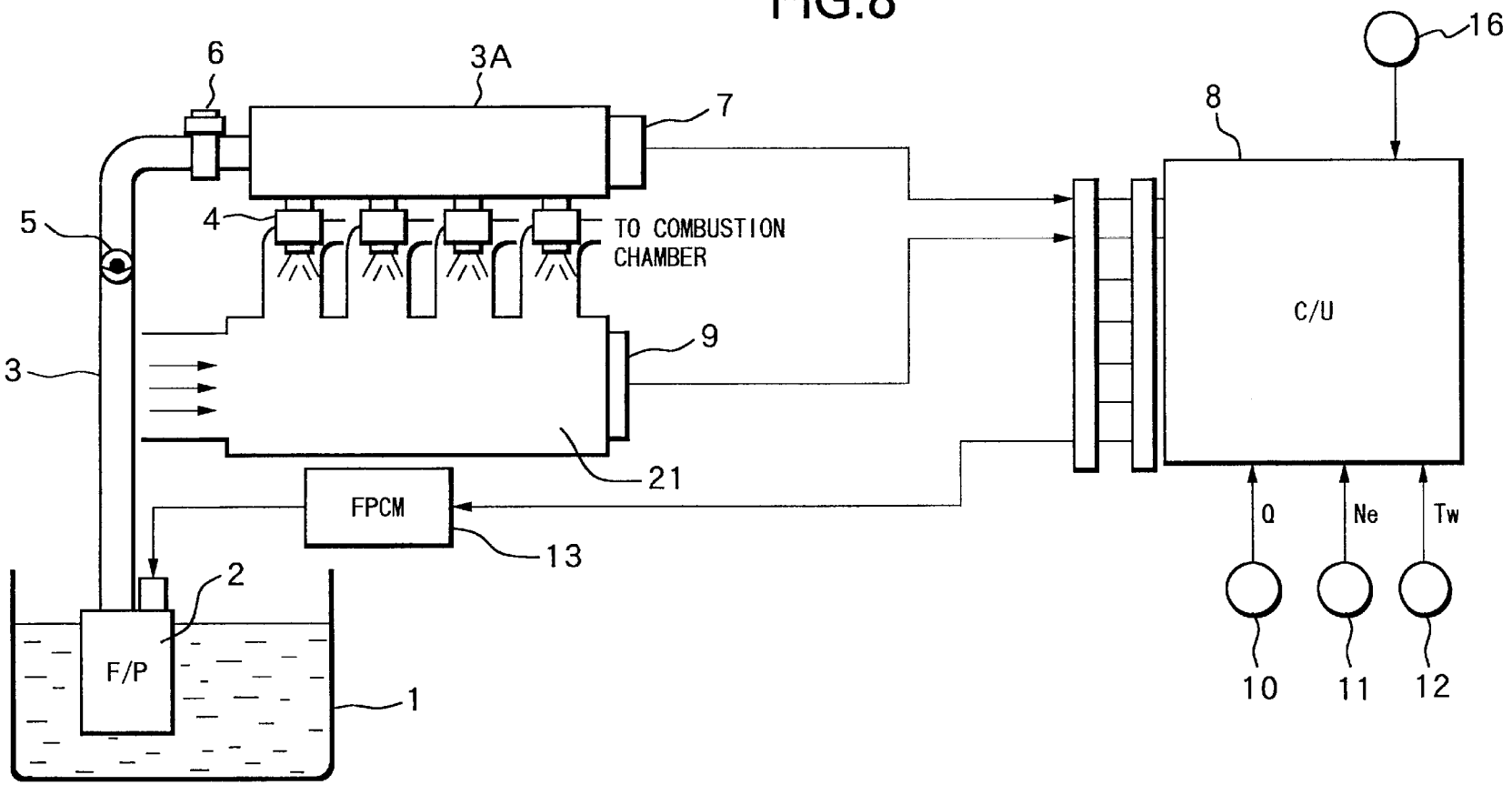
FIG. 8 is a diagram illustrating a system constitution of a fourth embodiment according to the present invention.

Next described below is a embodiment. As shown in FIG. 8, the system constitution is such that, in addition to the constitution of the first embodiment shown in FIG. 1, a fuel temperature sensor 16 for detecting the fuel temperature Tf is added to input a signal of the fuel temperature Tf to the control unit 8. The lower limit value of the target fuel pressure is set based on the fuel temperature Tf.

Figure 9:
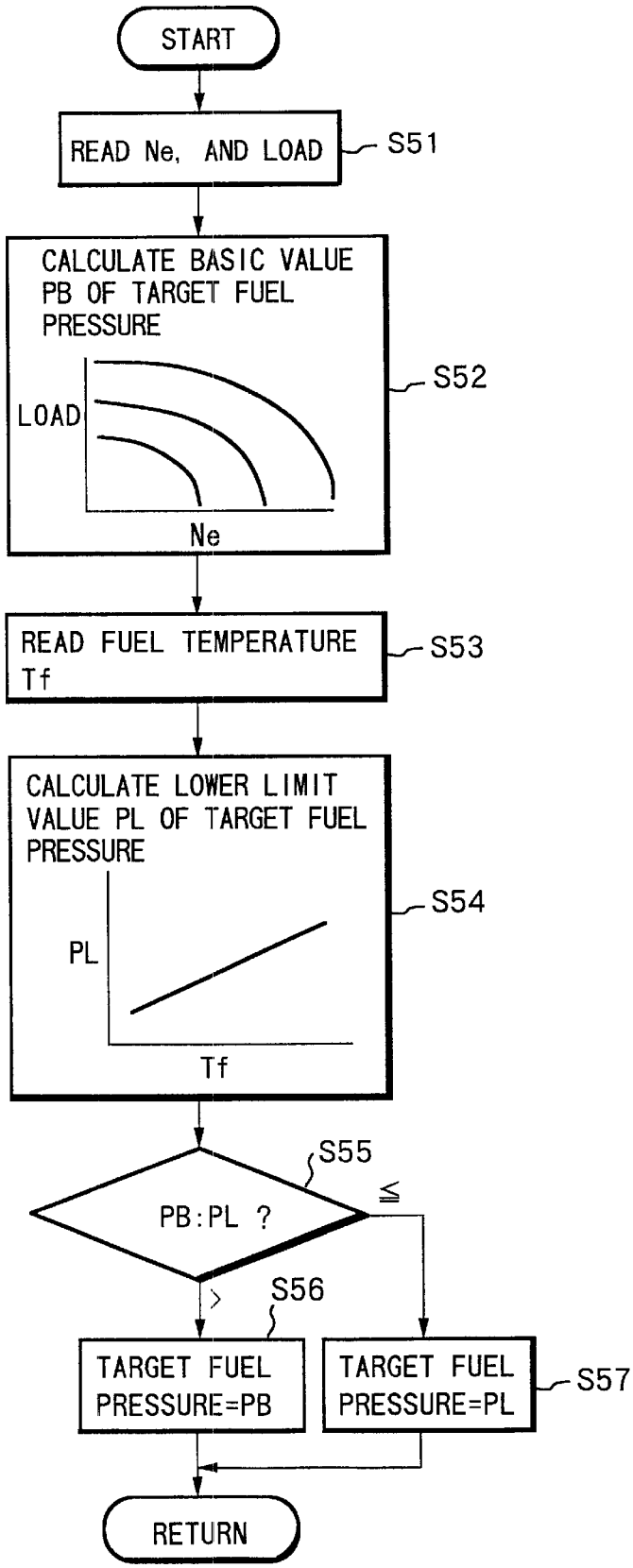
FIG. 9 is a flowchart of a fuel pressure control routine according to the fourth embodiment.

The fuel pressure control according to the fourth embodiment will now be described with reference to a flowchart shown in FIG. 9.

The control of the fourth embodiment is the same as that of the first embodiment with the exception that the fuel temperature Tf detected by the fuel temperature sensor 16 is read and the lower limit value PL of the target fuel pressure is calculated based on the fuel temperature Tf at steps 53 and 54.

According to this constitution, the lower limit value PL can be most accurately set(can be set to a fuel pressure closer tot he real limit of fuel vapor generation) based on the detected fuel temperature Tf, making it possible to most efficiently achieve the prevention of the fuel vapor generation and the reduction of fuel economy.

The entire contents of Japanese Patent Application NO. 11-340071, filed Nov. 30, 1999, are incorporated herein by reference.

What is claimed is:

1. A fuel pressure control device of an engine comprising:

fuel pressure control means for controlling an operation of a fuel pump so that the pressure of fuel supplied from the fuel pump to a fuel injection valve becomes a target fuel pressure corresponding to the engine operation condition;

engine environmental temperature detecting means for detecting an engine environmental temperature condition; and target fuel pressure lower limit value setting means for setting a lower limit value of the target fuel pressure according to the engine environmental temperature.

2. A fuel pressure control device of an engine according to claim 1, wherein said engine environmental temperature detecting means detects the engine environmental temperature condition based on the detected value of an engine cooling water.

3. A fuel pressure control device of an engine according to claim 1, wherein said engine environmental temperature detecting means detects an outer air temperature in addition to an engine cooling water temperature to detect the engine environmental temperature condition based on these detected values.

4. A fuel pressure control device of an engine according to claim 1, wherein said engine environmental temperature detecting means detects an ON or OFF state of an air conditioner in addition to an engine cooling water temperature to detect the engine environmental temperature condition based on these detected values.

5. A fuel pressure control device of an engine according to claim 1, wherein said engine environmental temperature detecting means detects a fuel temperature to detect the engine environmental temperature condition based on said detected value.

6. A fuel pressure control device of an engine according to claim 1, wherein there is additionally provided fuel pressure feedback control means for feedback controlling the operation of the fuel pump based on the detected value of the fuel pressure so that the fuel pressure becomes a target fuel pressure according to the engine operation condition.

7. The fuel pressure control apparatus as recited in claim 1, further comprising a target fuel pressure selecting means for selecting between a calculated basic target fuel pressure and a set lower limit value of target fuel pressure.

8. A fuel pressure control method an engine comprising the steps of:

controlling an operation of a fuel pump so that the fuel pressure supplied from the fuel pump to a fuel injection valve becomes a target fuel pressure corresponding to the engine operation condition;

detecting an engine environmental temperature condition; and setting a lower limit value of the target fuel pressure according to the engine environmental temperature.

9. A fuel pressure control method of an engine according to claim 8, wherein an engine cooling water temperature is detected to detect the engine environmental temperature condition based on said detected value.

10. A fuel pressure control method of an engine according to claim 8, wherein an outer air temperature is detected in addition to an engine cooling water temperature to detect the engine environmental temperature condition based on these detected values.

11. A fuel pressure control method of an engine according to claim 8, wherein an ON or OFF state of an air conditioner is detected in addition to an engine cooling water temperature to detect the engine environmental temperature condition based on these detected values.

12. A fuel pressure control method of an engine according to claim 8, wherein a fuel temperature is detected to detect the engine environmental temperature condition based on said detected value.

13. A fuel pressure control method of an engine according to claim 8, wherein the pressure of fuel supplied from the fuel pump to the fuel injection valve is detected to feedback control the operation of the fuel pump based on said detected value of the fuel pressure, so that the fuel pressure becomes a target fuel pressure according to the engine operation condition.

14. The fuel pressure control method as recited in claim 8, further comprising selecting between a calculated basic target fuel pressure and a set lower limit value of target fuel pressure.

* * * * *